US006431050B1

(12) United States Patent
Hausman et al.

(10) Patent No.: US 6,431,050 B1
(45) Date of Patent: Aug. 13, 2002

(54) APPARATUS FOR MULTIPLEXING A PLURALITY OF HYDRAULIC CYLINDERS

(75) Inventors: Dennis J. Hausman, Willow Spring, NC (US); Andrew H. Nippert, Peoria, IL (US); Mark D. Shane, Garner, NC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/603,641

(22) Filed: Jun. 26, 2000

(51) Int. Cl.[7] ..... F15B 13/00; F15B 11/00
(52) U.S. Cl. ..... 91/526; 91/536
(58) Field of Search ..... 91/526, 531, 536

(56) References Cited

U.S. PATENT DOCUMENTS 3,512,453 A * 5/1970 Balzer ..... 91/526
3,705,631 A 12/1972 Seaberg
3,774,696 A 11/1973 Horsch
3,972,185 A 8/1976 Medina
4,161,256 A 7/1979 Seaberg
4,736,673 A 4/1988 Harada et al.
4,802,537 A 2/1989 Ryerson
5,125,232 A 6/1992 Arii et al.
5,634,334 A * 6/1997 Hehl ..... 60/328

* cited by examiner

*Primary Examiner*—Edward K. Look
*Assistant Examiner*—Michael Leslie
(74) *Attorney, Agent, or Firm*—Steve D. Lundquist

(57) ABSTRACT

An apparatus for multiplexing a first hydraulic cylinder and a second hydraulic cylinder. Each cylinder has a head end port and a rod end port. The apparatus includes a tank, a pump connected to the tank, and a control valve having an inlet port connected to the pump, an outlet port connected to the tank, and first and second control ports. The apparatus also includes at least two two-position valves each having at least one port connected to a corresponding at least one of the first and second control ports and at least one other port connected to a corresponding one of the head end and rod end ports of the first and second hydraulic cylinders, the at least two two-position valves being operable to selectively divert hydraulic fluid from the respective first and second control ports of the control valve to one of the first and second hydraulic cylinders.

11 Claims, 6 Drawing Sheets

APPARATUS FOR MULTIPLEXING A PLURALITY OF HYDRAULIC CYLINDERS

TECHNICAL FIELD

This invention relates generally to an apparatus for multiplexing a plurality of hydraulic cylinders and, more particularly, to an apparatus for diverting hydraulic fluid flow to selectively multiplex a plurality of hydraulic cylinders.

BACKGROUND ART

Hydraulic systems are used to perform a wide variety of tasks. For example, hydraulic systems, in particular, electro-hydraulic systems, are used to provide the power needed for machines such as backhoe loaders, excavators, wheel loaders, track-type tractors, and the like to perform earth-working operations.

Machines such as the above have become increasingly more complex and sophisticated. A backhoe loader, for example, requires hydraulic power for several functions, such as swing, boom, stick, bucket, auxiliary, stabilizers, and such. The demands placed on a hydraulic system may exceed the power output available by the system. Therefore, systems have been designed which share, i.e., multiplex, operations. For example, control of tilt and swing cylinders may be multiplexed.

Multiplexed hydraulic systems require some means to control the flow of hydraulic fluid to the desired cylinders. Consequently, many valves have been developed to selectively divert hydraulic fluid to the desired location. These valves, however, add cost and complexity to the hydraulic system. The potential for mechanical problems, and the higher associated costs with parts replacement, create additional concerns for an equipment operator who must optimize productivity and minimize costs.

It is therefore desired to provide hydraulic multiplexing with divertor valves that are low cost and readily replaceable. It is also desired to provide divertor valves that are not complex in design or construction, and therefore are less prone to mechanical failure.

The present invention is directed to overcoming one or more of the problems as set forth above.

DISCLOSURE OF THE INVENTION

In one aspect of the present invention an apparatus for multiplexing a first hydraulic cylinder and a second hydraulic cylinder is disclosed. Each cylinder has a head end port and a rod end port. The apparatus includes a tank, a pump connected to the tank, and a control valve having an inlet port connected to the pump, an outlet port connected to the tank, and first and second control ports. The apparatus also includes at least two two-position valves each having at least one port connected to a corresponding at least one of the first and second control ports and at least one other port connected to a corresponding one of the head end and rod end ports of the first and second hydraulic cylinders, the at least two two-position valves being operable to selectively divert hydraulic fluid from the respective first and second control ports of the control valve to one of the first and second hydraulic cylinders.

BRIEF DESCRIPTION OF THE DRAWINGS

FIG. 6 is a diagrammatic illustration of the third embodiment depicted in an application of the present invention.

BEST MODE FOR CARRYING OUT THE INVENTION

Figure 1:
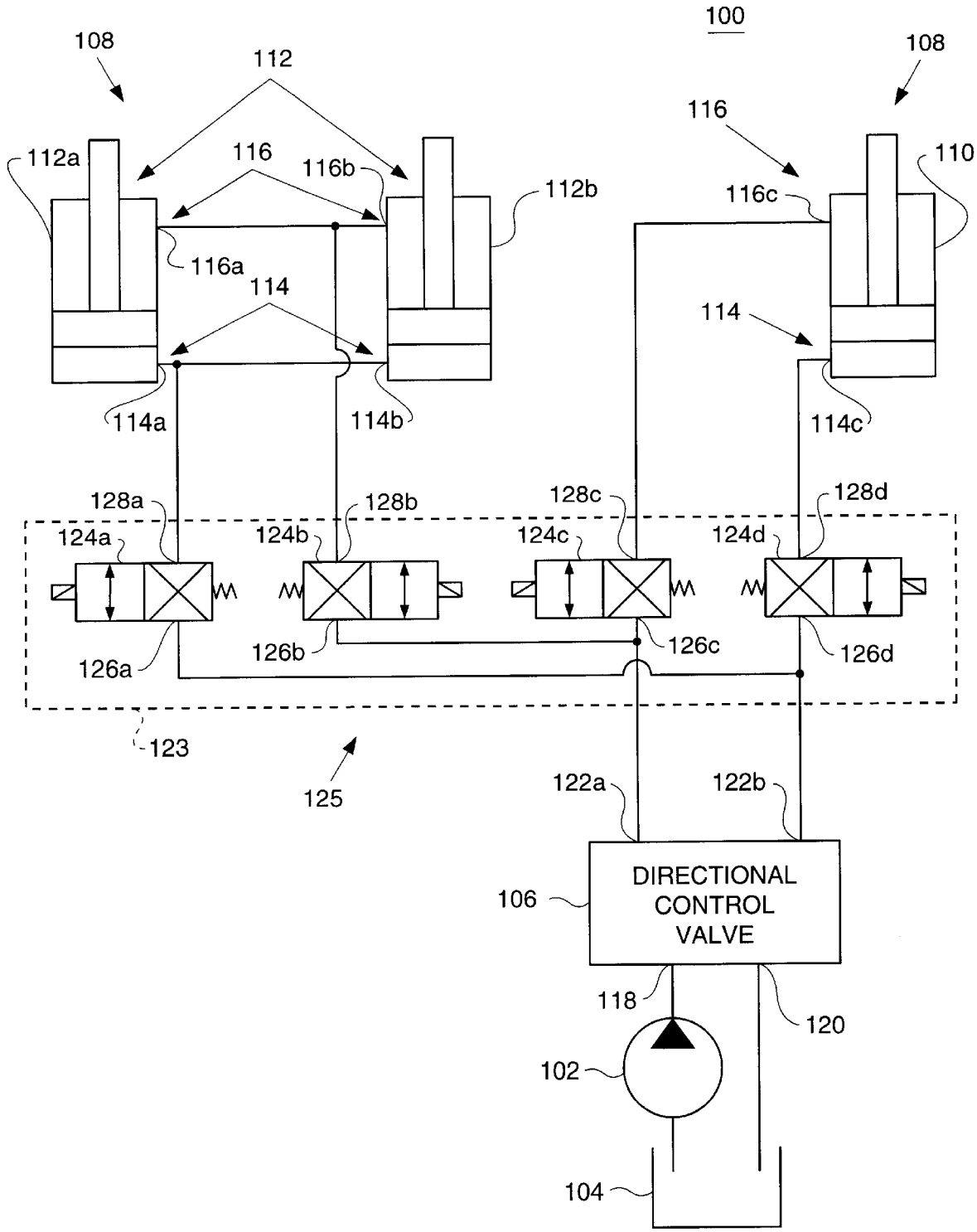
FIG. 1 is a diagrammatic illustration of a first embodiment of the present invention.

Referring to FIG. 1, a diagrammatic illustration of a first embodiment of the present invention is shown. A system 100 embodied in FIG. 1 is typical of an electro-hydraulic system used to perform a variety of work tasks. For example, electro-hydraulic systems are used extensively on earth-working machines, construction machines, manufacturing machinery, and other applications which require great amounts of force to perform the required work.

A pump 102 receives hydraulic fluid from a tank 104, and delivers the fluid to perform the required work. The structure and operation of hydraulic pumps and tanks are well known in the art and therefore need not be described further.

A control valve 106, preferably a directional control valve, receives fluid from the pump 102 at an inlet port 118, directs the fluid to perform the work in a controlled manner, and returns the fluid to the tank 104 by way of an outlet port 120. Preferably, the fluid is delivered from the control valve 106 through first and second control ports 122*a,b*.

Figure 4:
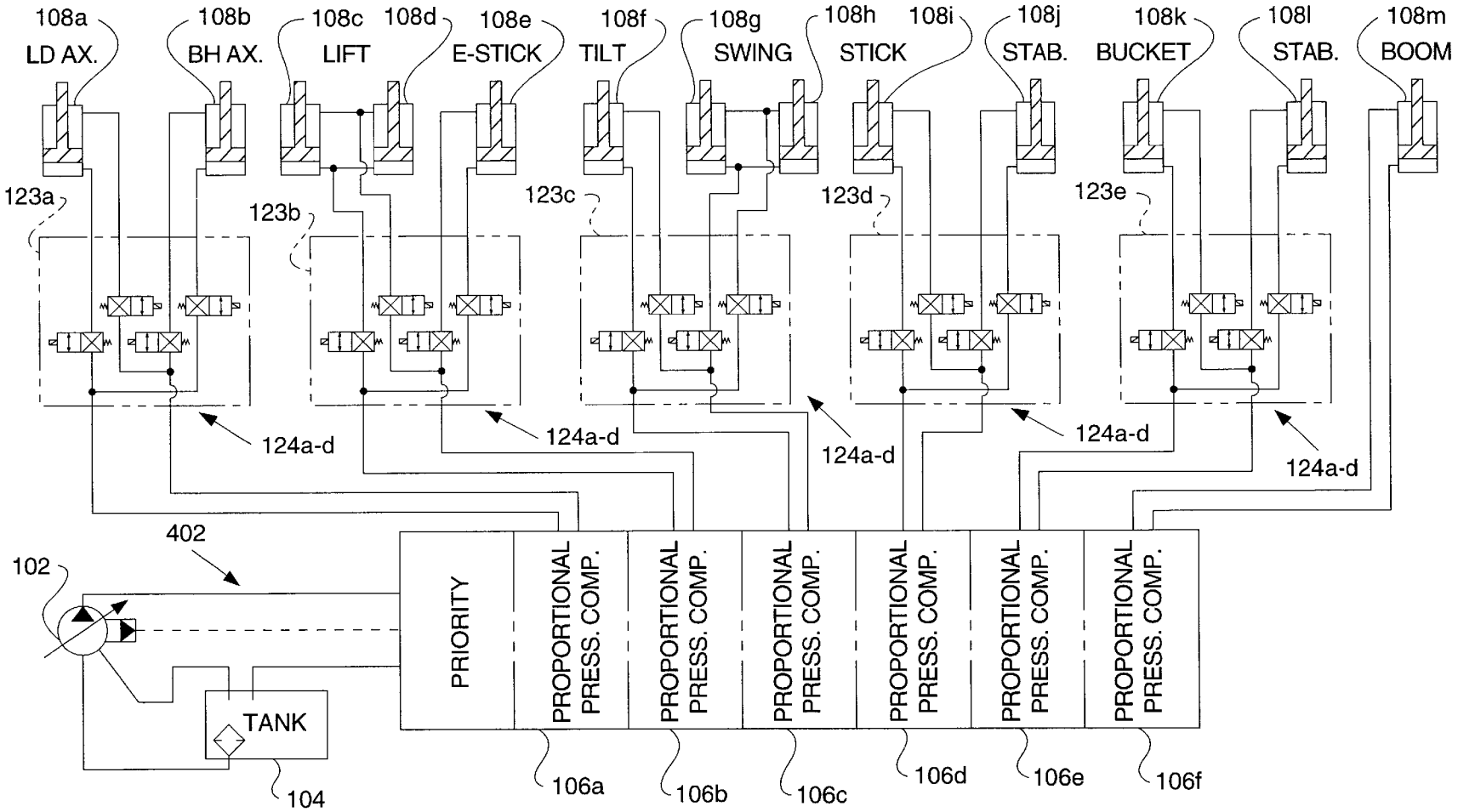
FIG. 4 is a diagrammatic illustration of the first embodiment depicted in an application of the present invention.
Figure 5:
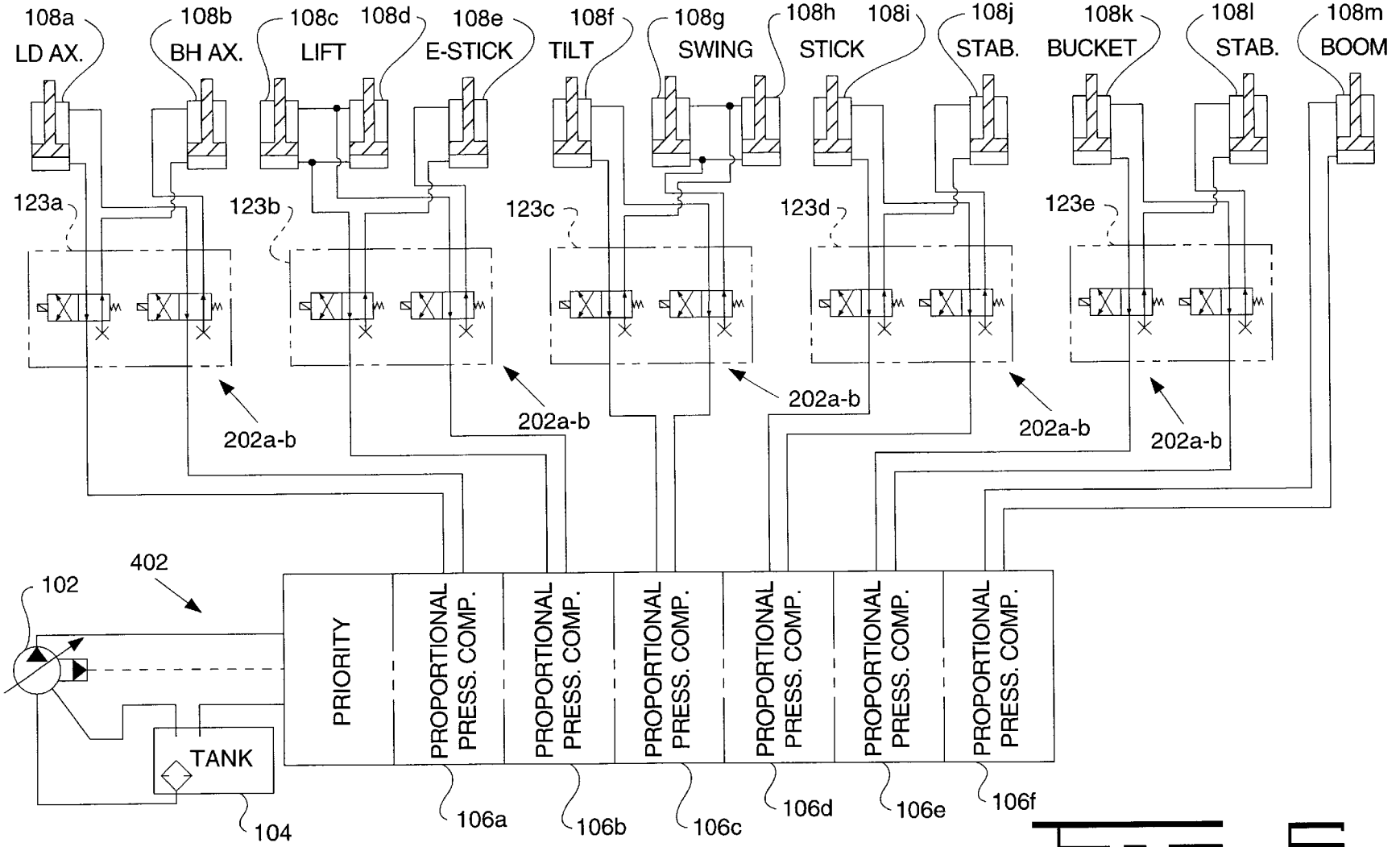
FIG. 5 is a diagrammatic illustration of the second embodiment depicted in an application of the present invention.
Figure 5:
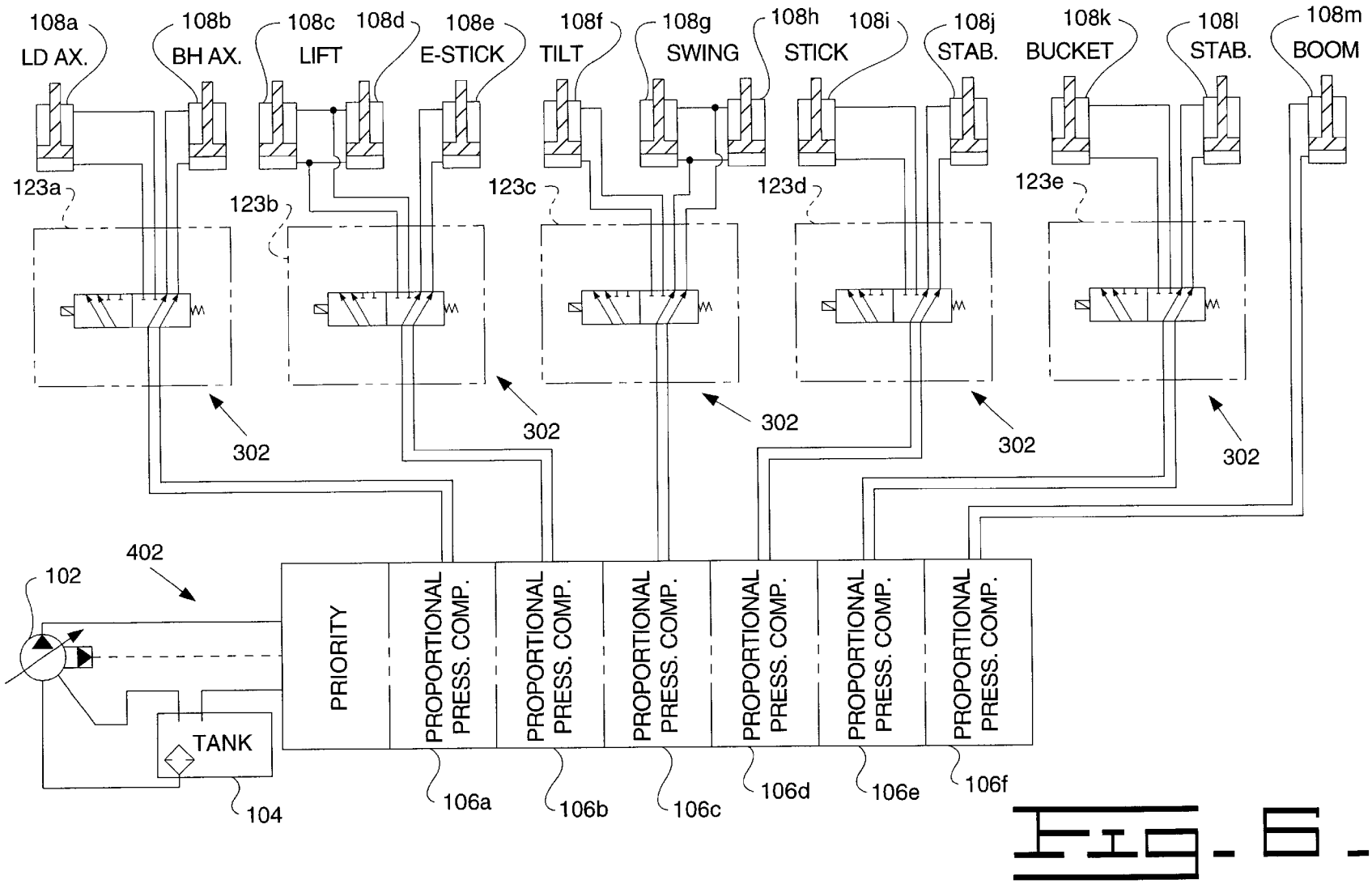

In the preferred embodiment of the present invention, the control valve 106 is a programmable control valve; for example, a proportional pressure compensating valve 106*a–f*, as shown in FIGS. 4–6. A programmable control valve of this nature is adapted to provide desired hydraulic control characteristics as a function of a load requirement of the electro-hydraulic system. Preferably, the control valve 106 is controlled by an electronic control system (not shown), such as a microprocessor based control system, to change the hydraulic control characteristics as desired. The hydraulic load characteristics provided by the control valve 106 is described in more detail below.

A plurality of hydraulic cylinders 108 receives the hydraulic fluid from the control valve 106, and responsively performs work functions by means well known in the art. FIG. 1 illustrates three hydraulic cylinders 108; a first hydraulic cylinder 110, and a second hydraulic cylinder 112 which actually includes two cylinders 112*a,b* configured to operate together. Preferably, the first and second cylinders 110,112 are adapted to perform separate and independent work functions. For example, a backhoe loader used to perform earthworking operations may use the first cylinder 110 as a tilt cylinder and the second cylinder 112*a,b* as swing cylinders.

Each cylinder 108 has a head end port 114 and a rod end port 116 for hydraulic fluid to enter and exit.

Referring to the above example of tilt and swing cylinders for a backhoe loader, the embodiment shown in FIG. 1 is adapted to provide fluid to one of the first cylinder 110 and the second cylinder 112*a,b* by means that are described below. The fluid provided by the pump 102 and control valve 106 is directed to either the first cylinder 110, or the second cylinder 112*a,b*, but not to both at the same time. However, the hydraulic control characteristics may differ between the first and second cylinders 110, 112. For example, a tilt cylinder for a typical backhoe loader may require a maximum flowrate of 148 liters per minute (lpm) within a first pressure range, and the swing cylinders on the same machine may require a maximum flowrate of 80 lpm within a second pressure range. Therefore, the first and second cylinders 110,112, although they share the same control valve 106, are not matched in characteristics. As a result, the control valve must be adapted to change the control characteristics to provide the proper flow rate and pressure level to the cylinder in use. A programmable control valve, such as the proportional pressure compensating control valves 106*a–f* of FIGS. 4–6, is suited for this application.

The above changes in control characteristics must be performed in a timely manner, i.e., when fluid flow is switched between the first and second cylinders 110, 112. In the preferred embodiment, the switching is performed by at least one two-position valve 123, located between the control valve 106 and the cylinders 108. Preferably, the at least one two-position valve 123 is an electro-hydraulic valve, and is controlled by the same electronic control system (not shown) which controls the control valve 106, thus providing controlled switching at the proper time.

With continued reference to FIG. 1, a plurality of two-position, two-way valves 124*a–d* are adapted to divert hydraulic fluid from the control valve 106 to one of the first and second cylinders 110,112. Specifically, two-way valves 124*b,c* each have a first port 126*b,c* connected to the first control port 122*a* of control valve 106, and two-way valves 124*a,d* each have a first port 126*a,d* connected to the second control port 122*b* of control valve 106. In addition, two-way valve 124*a* has a second port 128*a* connected to the head end ports 114*a,b* of cylinders 112*a,b*, two-way valve 124*b* has a second port 128*b* connected to the rod end ports 116*a,b* of cylinders 112*a,b*, two-way valve 124*c* has a second port 128*c* connected to the rod end port 116*c* of cylinder 110, and two-way valve 124*d* has a second port 128*d* connected to the head end port 114*c* of cylinder 110.

The two-way valves 124*a–d* are preferably configured to selectively divert hydraulic fluid from the first and second control ports 122*a,b* of the control valve 106 to one of the first and second cylinders 110,112. For example, if it is desired to divert fluid to the first cylinder 110, two-way valves 124*c,d* open and valves 124*a,b* close, thus supplying fluid to the first cylinder 110 and preventing fluid from being supplied to the second cylinder 112.

The two-way valves 124*a–d* may be packaged in a divertor valve assembly 125, i.e., the two-way valves 124*a–d* are included in one housing, which is installed as one unit. However, it is understood that the two-way valves 124*a–d* may be included as separate valves, i.e., each valve is packaged and installed separately.

Preferably, the two-way valves 124*a–d* are non-proportional valves, i.e., they are adapted to function in one of an on and off state. However, the two-way valves 124*a–d* may be proportional valves without deviating from the spirit of the present invention. The use of proportional valves provides variable flow control, i.e., metering, to accomplish certain unique objectives. For example, the flow of fluid into a cylinder 108 may be controlled differently than the flow of fluid out of the same cylinder 108 to provide further control over the cylinder 108 over external forces such as gravity and the load being worked with.

The use of multiple two-way valves 124*a–d* in a divertor valve arrangement provides unique advantages over the use of a single valve. For example, each valve 124 is simple in design and construction and low cost, both for initial installation and for replacement purposes. A failure of one valve may be found more readily. The overall system may still function with a valve failure, since the other valves would continue to function properly.

Figure 2:
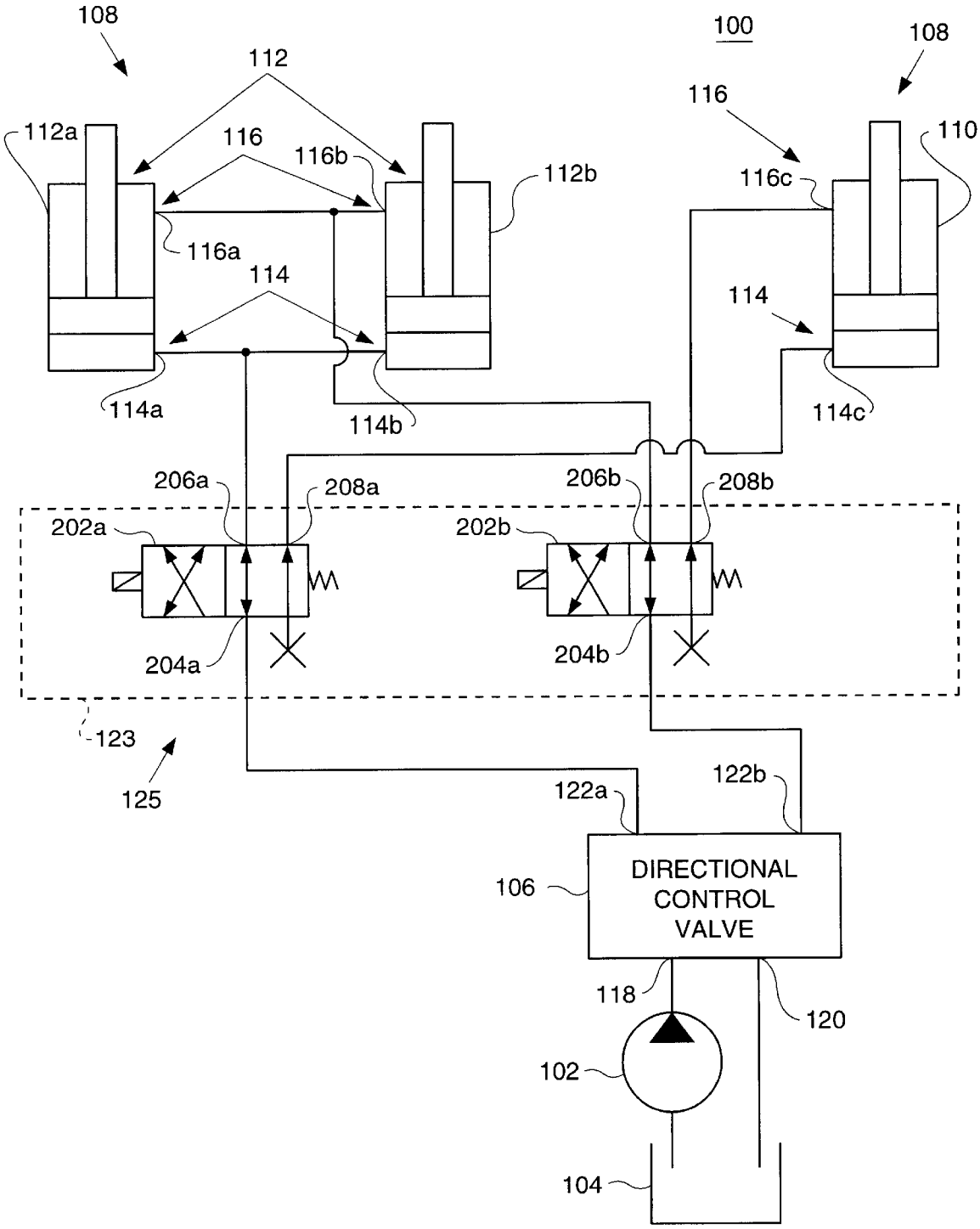
FIG. 2 is a diagrammatic illustration of a second embodiment of the present invention.

Referring to FIG. 2, a diagrammatic illustration of a second embodiment of the present invention is shown. The apparatus 100 of FIG. 2 is similar to the apparatus 100 described with respect to FIG. 1. However, the at least one two-position, two way valve 124 is replaced with at least one two-position, four-way valve 202.

The four-way valves 202*a,b* provide the same operation as the two-way valves 124*a–d* of FIG. 1. However, the four-way valves 202*a,b* are configured differently. Specifically, a first four-way valve 202*a* has a first port 204*a* connected to the first control port 122*a* of the control valve, and a second four-way valve 202*b* has a first port 204*b* connected to the second control port 122*b* of the control valve. In addition, the first four-way valve 202*a* has a second port 206*a* connected to the head end ports 114*a,b* of cylinders 112*a,b*, and a third port 208*a* connected to the head end port 114*c* of cylinder 110. The second four-way valve 202*b* has a second port 206*b* connected to the rod end ports 116*a,b* of cylinders 112*a,b*, and a third port 208*b* connected to the rod end port 116*c* of cylinder 110.

In operation, the four-way valves 202*a,b* are depicted in FIG. 2 as providing a path for fluid from the control valve 106 to the second cylinders 112*a,b*. If it is desired to provide fluid to the first cylinder 110 instead, the positions of the four-way valves 202*a,b* would switch such that the third ports 208*a,b* would be in line with the first ports 204*a,b*.

Figure 3:
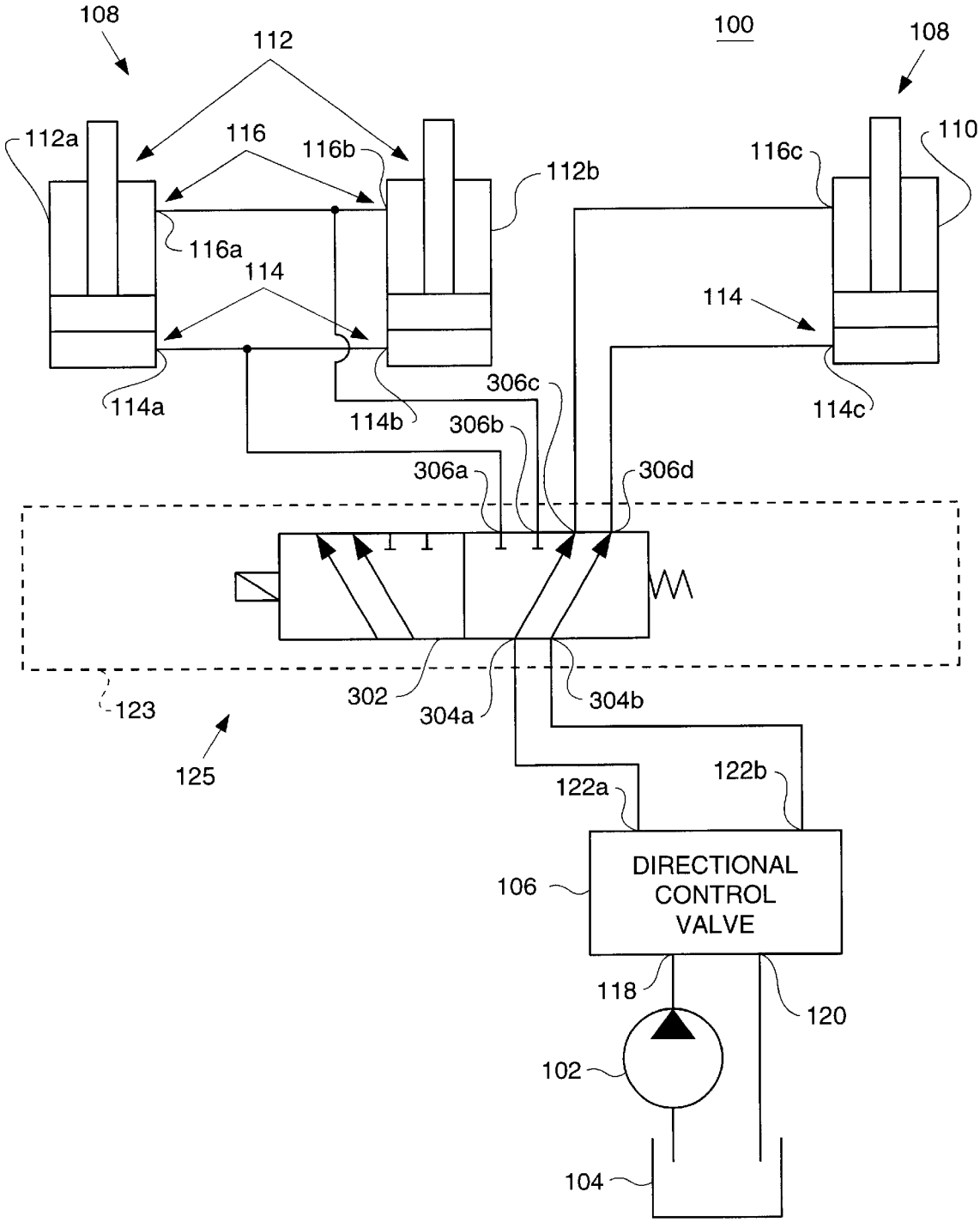
FIG. 3 is a diagrammatic illustration of a third embodiment of the present invention.

Referring to FIG. 3, a diagrammatic illustration of a third embodiment of the present invention is shown. The apparatus is similar to that of FIGS. 1 and 2, except that a two-position, six-way valve 302 is used in place of the two-way or four-way valves 124, 202.

The six-way valve 302 has first and second ports 304*a,b* connected respectively to the first and second control ports 122*a,b* of the control valve 106. The six-way valve 302 also has third, fourth, fifth, and sixth ports 306*a–d* connected respectively to the head end ports 114*a,b* of the second cylinders 112*a,b*, the rod end ports 116*a,b* of the second cylinders 112*a,b*, the rod end port 116*c* of the first cylinder 110, and the head end port 114*c* of the first cylinder 110.

The six-way valve 302, as shown in FIG. 3, is positioned to provide fluid to the first cylinder 110. If it is desired to provide fluid to the second cylinder 112 instead, the six-way valve 302 is switched to the alternate position.

FIGS. 4–6 are diagrammatic illustrations of the three embodiments in use with hydraulic systems located on a backhoe loader for earthworking operations. A typical backhoe loader has several hydraulic cylinders 108a–m which perform a multitude of tasks. Examples of uses of cylinders includes lift, tilt, swing, stick, bucket, boom, stabilizers, and auxiliary functions.

FIG. 4 is shown with a plurality of two-way valves 124 used for selectively diverting hydraulic fluid. FIG. 5 is shown with a plurality of four-way valves 202, and FIG. 6 is shown with a plurality of six-way valves 302. Otherwise, FIGS. 4–6 do not differ from each other.

Five proportional pressure compensating control valves 106*a–e* provide hydraulic fluid to ten cylinder functions through five sets of two-position valves 123*a–e*. In addition, a sixth proportional pressure compensating control valve 106*f* provides hydraulic fluid to cylinder 108m. Without the two-position valves 123*a–e*, eleven control valves 106 would be required.

Industrial Applicability

As an example of an application of the present invention, a hydraulically powered machine, such as a backhoe loader, uses hydraulics to perform many functions. As FIGS. 4–6 illustrate, each function is powered by one or more cylinders, which in turn are controlled by control valves. Each control valve may be complex and costly, perhaps having programmable features which provide the valve with sophisticated features, such as programmable pressure compensation. That is, the control valve may be capable of compensating the hydraulic pressure as a function of differing applications.

The present invention allows the use of programmable control valves for more than one hydraulic system by incorporating low-cost, two-position divertor valves to provide hydraulic fluid and pressure to a desired one of multiple hydraulic cylinders, possibly having unique operating requirements than other cylinders being multiplexed by the same control valve.

Other aspects, objects, and features of the present invention can be obtained from a study of the drawings, the disclosure, and the appended claims.

What is claimed is:

1. An apparatus for multiplexing a first hydraulic cylinder and a second hydraulic cylinder, each cylinder having a head end port and a rod end port, the apparatus comprising:

a tank;

a pump connected to the tank;

a control valve having an inlet port connected to the pump, an outlet port connected to the tank, and first and second control ports; and at least two two-position valves, a first portion of the two-position valves each having a first port connected to one of the first and second control ports and a second portion of the two-position valves each having a first port connected to the other one of the first and second control ports, and the first portion of the two-position valves each having a second port connected to one of the head end and rod end ports of the first and second hydraulic cylinders and the second portion of the two-position valves each having a second port connected to the other of the head end and rod end ports of the first and second hydraulic cylinders, the at least two two-position valves being operable to selectively divert hydraulic fluid from the respective first and second control ports of the control valve to one of the first and second hydraulic cylinders.

2. An apparatus, as set forth in claim 1, wherein at least one of the first and second hydraulic cylinders includes a plurality of cylinders.

3. An apparatus, as set forth in claim 2, wherein the at least two two-position valves includes a plurality of two-position, two-way valves, a first portion of the two-way valves each having a first port connected to one of the first and second control ports and a second portion of the two-way valves each having a first port connected to the other one of the first and second control ports, and the first portion of the two-way valves each having a second port connected to one of the head end and rod end ports of the plurality of cylinders and the second portion of the two-way valves each having a second port connected to the other of the head end and rod end ports of the plurality of cylinders, the plurality of two-way valves being operable to selectively divert hydraulic fluid from the respective first and second control ports of the control valve to a desired at least one of the plurality of cylinders.

4. An apparatus, as set forth in claim 3, wherein the plurality of two-position, two-way valves are configured in a divertor valve assembly.

5. An apparatus, as set forth in claim 2, wherein the at least two two-position valves includes a plurality of two-position, four-way valves, a first portion of the four-way valves each having a first port connected to one of the first and second control ports and a second portion of the four-way valves each having a first port connected to the other one of the first and second control ports, and the first portion of the four-way valves each having a second port and a third port connected to a corresponding one of the head end and rod end ports of the plurality of cylinders and the second portion of the four-way valves each having a second port and a third port connected to the corresponding other of the head end and rod end ports of the plurality of cylinders, the plurality of four-way valves being operable to selectively divert hydraulic fluid from the respective first and second control ports of the control valve to a desired at least one of the plurality of cylinders.

6. An apparatus, as set forth in claim 5, wherein the plurality of two-position, four-way valves are configured in a divertor valve assembly.

7. An apparatus, as set forth in claim 1, wherein the control valve is a programmable valve.

8. An apparatus, as set forth in claim 7, wherein the control valve is adapted to provide a first set of hydraulic control characteristics to the first hydraulic cylinder and a second set of hydraulic control characteristics to the second hydraulic cylinder.

9. An apparatus, as set forth in claim 8, wherein the first and second sets of hydraulic control characteristics are determined as a function of a load requirement of the respective first and second hydraulic cylinders.

10. An apparatus for multiplexing a first hydraulic cylinder and a second hydraulic cylinder, each cylinder having a head end port and a rod end port, the apparatus comprising:

a tank;

a pump connected to the tank;

a control valve having an inlet port connected to the pump, an outlet port connected to the tank, and first and second control ports; and a plurality of two-position, two-way valves, a first portion of the two-way valves each having a first port connected to one of the first and second control ports and a second portion of the two-way valves each having a first port connected to the other one of the first and second control ports, and the first portion of the two-way valves each having a second port connected to one of the head end and rod end ports of the first and second hydraulic cylinders and the second portion of the two-way valves each having a second port connected to the other of the head end and rod end ports of the first and second hydraulic cylinders, the plurality of two-way valves being operable to selectively divert hydraulic fluid from the respective first and second control ports of the control valve to one of the first and second hydraulic cylinders.

11. An apparatus for multiplexing a first hydraulic cylinder and a second hydraulic cylinder, each cylinder having a head end port and a rod end port, the apparatus comprising:

a tank;

a pump connected to the tank;

a control valve having an inlet port connected to the pump, an outlet port connected to the tank, and first and second control ports; and a plurality of two-position, four-way valves, a first portion of the four-way valves each having a first port connected to one of the first and second control ports and a second portion of the four-way valves each having a first port connected to the other one of the first and second control ports, and the first portion of the four-way valves each having a second port and a third port connected to a corresponding one of the head end and rod end ports of the first and second hydraulic cylinders and the second portion of the four-way valves each having a second port and a third port connected to the corresponding other of the head end and rod end ports of the first and second hydraulic cylinders, the plurality of four-way valves being operable to selectively divert hydraulic fluid from the respective first and second control ports of the control valve to a desired at least one of the first and second hydraulic cylinders.

* * * * *